US008807066B2

(12) United States Patent
Räikkönen

(10) Patent No.: US 8,807,066 B2
(45) Date of Patent: Aug. 19, 2014

(54) DEVICE FOR APPLYING ADHESIVE IN A SLITTER-WINDER OF FIBER WEB MACHINE

(75) Inventor: Mikko Räikkönen, Kerava (FI)

(73) Assignee: Valmet Technologies, Inc., Espoo (FI)

( * ) Notice: Subject to any disclaimer, the term of this patent is extended or adjusted under 35 U.S.C. 154(b) by 148 days.

(21) Appl. No.: 13/467,280

(22) Filed: May 9, 2012

(65) Prior Publication Data

US 2012/0285376 A1 Nov. 15, 2012

(30) Foreign Application Priority Data

May 10, 2011 (EP) ..... 11165406

(51) Int. Cl.

| | |
|---|---|
| ***B05C 11/00*** | (2006.01) |
| ***B05B 7/06*** | (2006.01) |
| ***B05B 13/02*** | (2006.01) |
| ***B05C 11/10*** | (2006.01) |
| ***B65H 19/28*** | (2006.01) |

(52) U.S. Cl.

USPC ..... 118/35; 118/325; 118/313; 118/315; 242/532

(58) Field of Classification Search

CPC ..... B65H 19/286; B65H 19/26; B05B 7/061; B05B 7/06

USPC ..... 118/313–315, 302, 35, 325, 679, 682; 242/532, 532.1–532.3, 521, 535; 156/380.7, 256, 247

See application file for complete search history.

(56) References Cited

U.S. PATENT DOCUMENTS

| | | | | |
|---|---|---|---|---|
| 4,775,110 | A * | 10/1988 | Welp et al. | 242/521 |
| 5,092,533 | A | 3/1992 | Gangemi | |
| 5,213,649 | A * | 5/1993 | Sepavich et al. | 156/380.7 |
| 5,679,408 | A * | 10/1997 | Eronen | 427/207.1 |
| 6,045,085 | A * | 4/2000 | Andersson et al. | 242/532.3 |
| 2012/0024123 | A1 * | 2/2012 | Nakajima et al. | 83/102 |
| 2012/0255679 | A1 * | 10/2012 | Haapanen | 156/459 |

FOREIGN PATENT DOCUMENTS

| | | | |
|---|---|---|---|
| DE | 102005059464 | A1 | 6/2007 |
| EP | 0765832 | A2 | 4/1997 |
| EP | 1541245 | A2 | 6/2005 |
| WO | 2008113889 | A2 | 9/2008 |
| WO | 2008148937 | A1 | 12/2008 |
| WO | 2011076997 | A1 | 6/2011 |

OTHER PUBLICATIONS

European Search Report for EP11165406 dated Oct. 20, 2011.

* cited by examiner

*Primary Examiner* — Yewebdar Tadesse
(74) *Attorney, Agent, or Firm* — Stiennon & Stiennon

(57) ABSTRACT

A device (30) for applying adhesive is used in fiber web machine slitter-winder. The slitter-winder has an unwinder for a machine roll, slitter blades for slitting the unwound web into partial webs, and a winder forming them into rolls. The device (30) applies adhesive on ends of partial webs attaching the ends of the partial webs onto the web rolls. The device (30) has a support structure (31), a moving element (32) on the support structure and two adhesive nozzles (33, 34) on the moving element. The adhesive nozzles (33, 34) are attached to the moving element (32) such that the nozzles (33, 34) are spaced apart in the direction of travel of the moving element (32) so that a trailing nozzle can be accelerated to operating speed before traversing the partial webs, and a leading nozzle can extend further in the direction of travel than the moving element.

5 Claims, 2 Drawing Sheets

DEVICE FOR APPLYING ADHESIVE IN A SLITTER-WINDER OF FIBER WEB MACHINE

CROSS REFERENCES TO RELATED APPLICATIONS

This application claims priority on Finnish Application No. EP11165406, filed May 10, 2011, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a device for applying adhesive in a slitter-winder of a fiber web machine.

In manufacturing lines known from the prior art fiber web making takes place as a continuous process. A fiber web completing in a machine is wound with a reel-up around a reeling shaft i.e., a reel spool, into a machine roll (a parent roll). The purpose of reeling is to modify the web manufactured as planar into a more easily processable form. In the reel-up the continuous process of the machine breaks for the first time and shifts into periodic operation. This periodicity is tried to be made with efficiency as good as possible in order not to waste already done work in earlier process stages.

The machine roll web produced in fiber web making is full-width so it must be slit into partial webs with suitable width and the partial webs are wound to partial web rolls (customer rolls) with suitable length and diameter for the customers. The slitting and winding take place as known from prior art in an appropriate separate machine, i.e. in a slitter-winder.

As known from the prior art, in the slitter-winder the machine roll is unwound, the wide web is slit on the slitting section into several narrower partial webs, into at least two partial webs, which are wound up on the winding section around winding cores, such as spools, into customer rolls. When the customer rolls reach a desired length and diameter the partial webs are cut in the cross-direction. Tails of the partial webs are attached to the surfaces of customer rolls by applying adhesive to the surface of the fiber web, which adhesive then attaches the tails to the surface of the customer rolls. When the customer rolls are completed, the slitter-wider is stopped and the rolls, i.e. the so-called set, is removed from the slitter-winder after which the process is continued with the winding of a new set. These stages are repeated periodically until paper runs out of the machine roll, whereby the machine roll change is performed and the operation starts again.

It is known from prior art to apply adhesive for attaching the tail of the fiber web to the surface of the customer roll by means of a device traversing in the transverse direction of the running direction of the web. In publication GB 2061234 an adhesive applying apparatus is described in which adhesive is introduced while the web is moving and an adhesive stripe substantially in the transverse direction of the running direction of the web is applied.

WO publication 2008/148937 describes an apparatus for applying adhesive onto a moving web, containing an application head provided in connection with a support structure extending essentially in the transverse direction across the web, the support structure comprising a guide extending across the web into which the application head has been disposed movably, and the application head has been arranged to form onto the surface of the web an adhesive stripe essentially in the transverse direction in relation to the web running direction while the web is moving. This prior art apparatus comprises means for changing the movement direction of the application head during the application of adhesive and/or that the application apparatus includes means for changing the movement speed of the application head during the application of adhesive. According to one embodiment of this prior art apparatus it comprises more than one application head and in FIG. 4 of the WO publication is disclosed one example for this embodiment. In this example the apparatus comprises two application heads that according to the figure each have a carriage of its own and own movement path on the support structure that extends across all the partial webs and as shown in the figure over the web area in each end.

Even though the above apparatus has in most cases proven to be well functioning it is not suitable in all cases and it is problematic in particular in connection with narrow machines. In connection with narrow machines the space requirement in the width direction is more than is available and thus in prior art two separate, staggered support structures have been used.

The device for applying adhesive in a slitter-winder has typically been located underneath the web and under the slitter-winder between carrier beams. In an operation situation when adhesive is applied, high movement speed of the adhesive nozzle is needed which leads to a need of high acceleration speed.

SUMMARY OF THE INVENTION

An object of the present invention is to provide for an improved device for applying adhesive in a slitter-winder of a fiber web machine which has a simple structure and in which the movement speed required for applying adhesive is reliably reached.

A further object of the present invention is to provide a device for applying adhesive in a slitter-winder of a fiber web machine in which the disadvantages of the prior art are eliminated or at least minimized.

A further object of the present invention is to provide the effect of fast acceleration and the effect of reliable adhesive applying in which the supply of adhesive between nozzles is changeable such that only one nozzle is supplying adhesive at a time.

In view of achieving the objects stated above and those that will come out later the device for applying adhesive in a slitter-winder of a fiber web machine in accordance with the invention has two adhesive nozzles that are attached to the same moving element such that the nozzles are spaced apart in the cross-direction in relation to the running direction of the web.

In the device according to the invention there are two adhesive nozzles that are attached to the same moving element such that the nozzles are spaced apart. The moving element is movable along the support structure that extends over the partial webs in the cross-direction in relation to the running direction of the web. Advantageously the nozzles are attached symmetrically in respect to the middle line of the moving element and extending to opposite directions such that they are spaced apart.

According to an advantageous embodiment, the distance between the spaced apart nozzles in the cross-direction is calculated by the formula D=2(A+B−C), in which:

D is the distance between the nozzles,

A is the distance from the center line of moving element to maximum trim (=maximum location of the edge of the outermost partial web), B is the acceleration distance from 0 speed to adhesive applying speed, and C is the distance of non adhesive area at the edge of the web.

In home position, i.e. in the position where the device is located for beginning to apply the adhesive, one nozzle extends to the opposite direction in relation to the movement direction of the moving element a distance, that provides the time needed to accelerate the speed to adhesive applying speed before the start point of adhesive applying, if the distance is enough for accelerating the device to the desired adhesive applying speed or, if the distance is too short, the adhesive applying may be started during the accelerating phase. At least at the end of applying the adhesive the second nozzle is used since the first nozzle does not reach all the way to the end.

The adhesive supply for each nozzle is controlled advantageously such that the supply is provided mainly for the nozzle that is in use. The change of using the other nozzle instead of the one used can be at any location before the end length of adhesive applying that is not reachable by the first nozzle. Advantageously the change point is located in the middle part of the adhesive applying length. During the change phase adhesive is supplied to both nozzles for the time corresponding to that of the distance between the nozzles or the supply is alternated between the nozzles during the change phase, for example for the time corresponding to that of the distance between the nozzles. The adhesive supply can be continuous or discontinuous.

By the invention the space needed for the device for applying adhesive in a slitter-winder of a fiber web machine is reduced and only one support structure is needed.

In the device of the invention is a new technical effect achieved by the new construction of nozzle arrangement which provides for a movement length for accelerating the nozzle in to the adhesive applying speed without extending the support structure for providing further movement space for the movement element of the nozzle. By the inventive arrangement extra movement space is created without needing more space for the actual device. The device according to the invention is suitable for use both in situations when the adhesive is applied while the web is moving and in situations when the adhesive is applied while the web run is stopped.

In the following the invention is discussed in more detail by reference to figures of the accompanying drawings.

DESCRIPTION OF THE PREFERRED EMBODIMENTS

In the following description the same reference signs designate similar components unless otherwise mentioned. It should be understood, moreover, that the examples are susceptible of modification in order to adapt to different usages and conditions within the frames of the invention. In the following example the invention is explained in reference to a slitter-winder with a two-drum winder but it should be understood that the invention is as well applicable in connection with slitter-winders with a different type of winder for example with a center wind-up or a multistation winder.

Figure 1:
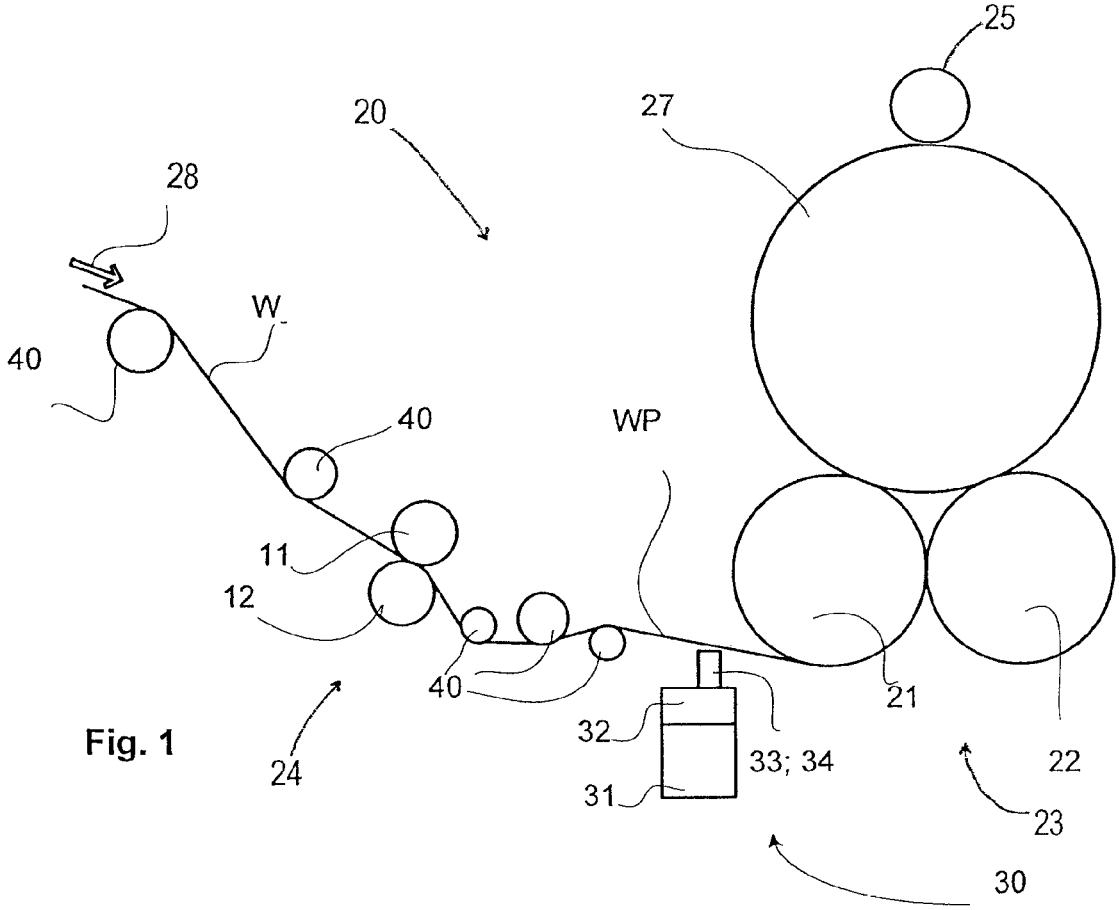
FIG. 1 shows schematically a slitter-winder.

FIG. 1 shows schematically a slitter-winder 20 which comprises a two-drum winder 23 and a slitting section 24 preceding the winder. In the slitting section of the slitter-winder the fiber web W is slit length-wise into parallel partial webs WP which are wound in the winder to a set of successive rolls 27. The winder shown in the figure is the two-drum winder 23 which comprises two winding rolls, i.e. carrier rolls 21, 22. In a two-drum winder one winding roll can also be a set of belt rolls depending on the type of two-drum winder in which an endless loop of belt/belts is arranged around two rolls. In the winder the longitudinally successive web rolls 27 are supported by the winding rolls 21, 22 from below thereof and by a pressing device 25 from above the web roll 27. The guide rolls 40 direct and support the travel of the web W/partial webs WP. In the slitting section 24 the web W is cut in the longitudinal direction (i.e., the running direction 28) into partial webs WP between slitter blades 11, 12. The device 30 for applying adhesive is located below the run of the partial webs WP after the slitter blades 11, 12 before the first winding roll 21 of the winder. The device 30 for applying adhesive comprises nozzles 33; 34, a moving element 32 and a support element 31. The support element is attached to the frame structures of the slitter-winder (not shown).

Figure 2:
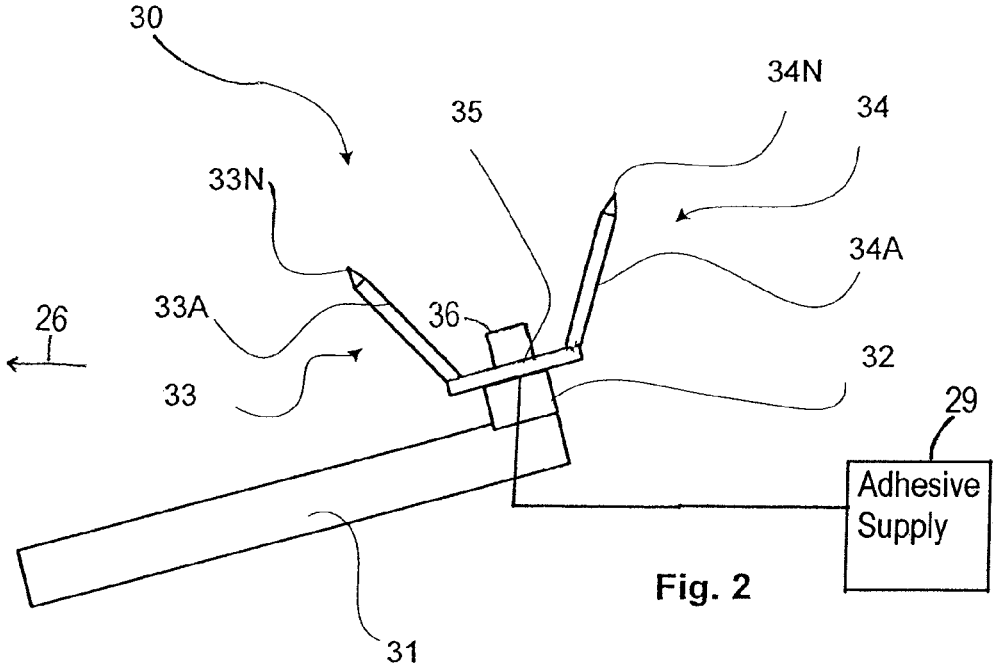
FIG. 2 shows schematically one example of one embodiment of a device according to the invention.

As shown in FIGS. 1 and 2 in the device 30 for applying adhesive there are adhesive nozzles 33, 34 that are mounted to a connecting arm 35 and thereby attached to the same moving element 32 such that the nozzles are spaced apart. The nozzle heads 33N, 34N are located at the end of nozzle arms 33A, 34A that are attached to the moving element 32. The moving element 32 is movable along the support structure 31 that extends over the partial webs WP in a cross-direction in relation to the running direction, as shown by arrow 28, of the web W.

Advantageously the nozzle heads 33N, 34N are attached by the nozzle arms 33A, 34A symmetrically in respect to the middle line of the moving element 32 and extending to opposite directions such that they are spaced apart. The distance (also FIG. 4) between the spaced apart nozzles heads 33N, 34N in the cross-direction is the distance between the spaced apart nozzles in the cross-direction and is calculated by the formula D=2(A+B−C), in which D is the distance between the nozzles A is the distance from the center line of moving element to maximum trim (=maximum location of the edge of the outer most partial web)

B is the acceleration distance from 0 speed to adhesive applying speed

C is the distance of non adhesive area at the edge of the web.

In home position, i.e., in the position where the nozzles 33, 34 of the device 30 are located for beginning to apply the adhesive, one nozzle, nozzle 34 in the example of FIG. 2, extends in a direction opposite the movement direction, shown by arrow 26, of the moving element 32, a distance that provides the time needed to accelerate the speed of the moving element 32 to adhesive applying speed before the start point of adhesive applying, at the edge of the outermost partial web. The moving element 32 moves the nozzles 33, 34 across the partial webs WP in the cross direction and adhesive is applied by the nozzles on the partial webs. At least at the end of applying the adhesive the second nozzle 33 is used since the first nozzle 34 does not reach all the way to the end. The adhesive applying to one nozzle 34 to the other nozzle is changed at a desired point of the movement of the nozzles 33, 34 in the cross-direction of the partial webs. The change to using the second nozzle instead of the first one used can be at any location before the end length of adhesive applying that is not reachable by the first nozzle 34. The adhesive supply 29 for each nozzle 33, 34 is controlled by a controller 36 advantageously such that the supply is provided mainly for the nozzle 33, 34 that is in use or adhesive is supplied during the change phase to both nozzles for the time corresponding to that of the distance between the nozzles or the supply is alternated between the nozzles during the change phase for example for the time corresponding to that of the distance between the nozzles. Advantageously the change point is located in the middle part of the adhesive applying length. The adhesive supply 29 can be continuous or discontinuous.

Figure 3:
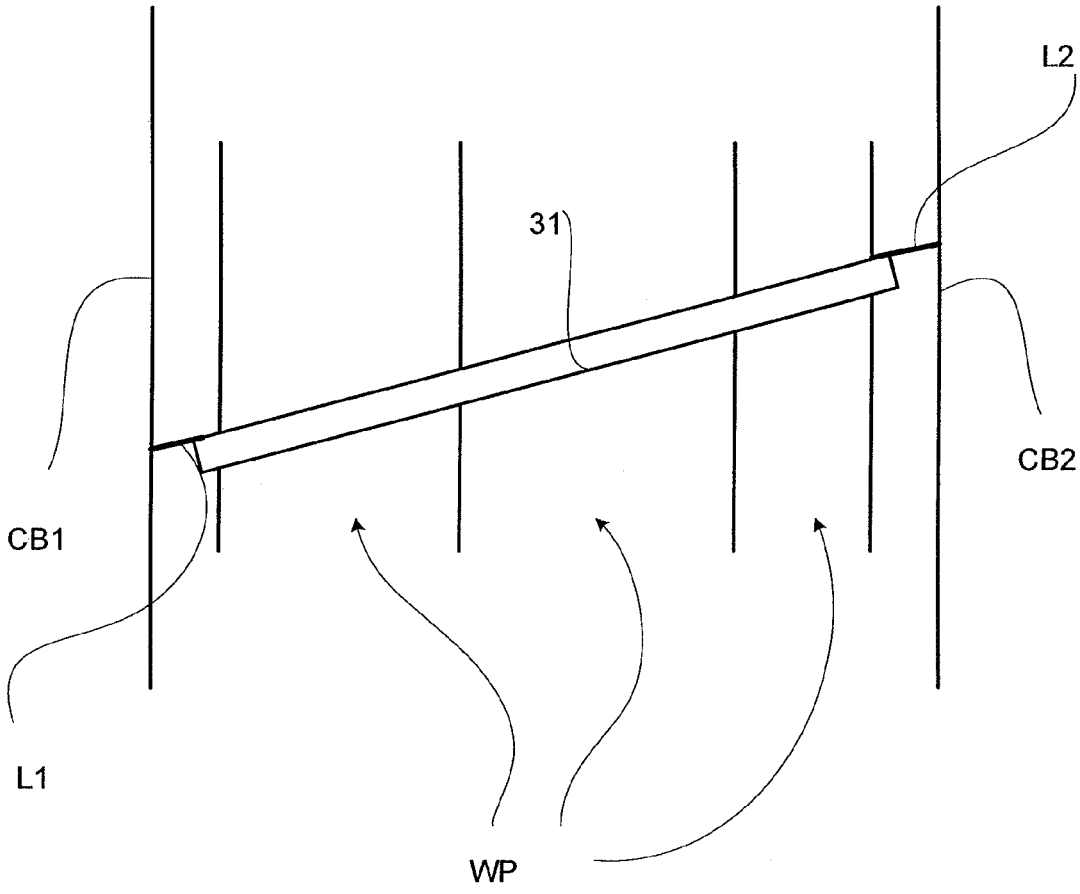
FIG. 3 shows schematically one example arrangement of a device according to the invention.

In FIG. 3 a schematic plan view from below is shown. The support structure 31 provides for the moving path for the moving element 32 (FIGS. 1 and 2) and extends in cross-direction in relation to the running direction of the partial webs WP. The outermost locations i.e. home position at each end of the movement path for nozzles 33, 34 respectively are shown in the figure as lines L1; L2 extending as close as possible to the immediate vicinity to the carrier beams CB1; CB2 that form part of the frame structure of the slitter-winder. The outermost location of a nozzle 33; 34 is for example 225 mm over the edge of the outermost partial web.

Figure 4:
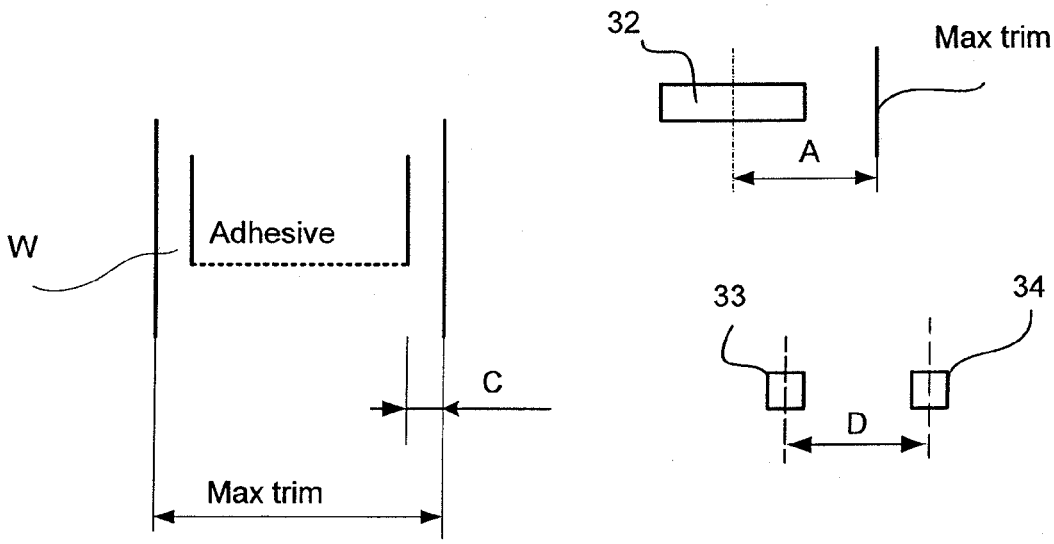
FIG. 4 a schematic illustration of the calculation of distance between nozzles.

In FIG. 4 a schematic illustration of calculation of distance between nozzles is shown. The distance between the spaced apart nozzles 33, 34 in the cross-direction is calculated by the formula D=2(A+B−C), in which D is the distance between the nozzles 33, 34

A is the distance from the center line of the moving element 32 to maximum trim of the web W (=maximum location of the edge of the outermost partial web)

B is the acceleration distance from 0 speed to adhesive applying speed

C is the distance of no adhesive area at the edge of the web W.

Above the invention has been described with reference to some preferred exemplifying embodiments of the same only, and the invention is, however, by no means to be strictly confined to the details of said embodiments and many modifications and variations are possible.

I claim:

1. A device for applying adhesive in a slitter-winder of a fiber web machine, wherein the slitter-winder comprises:

an unwinder for unwinding a machine roll in a running direction defined by a fiber web which is unwound from the machine roll;

slitter blades for slitting the fiber web unwound from the machine roll into partial webs;

a winder for winding the partial webs onto fiber web rolls;

wherein the device for applying adhesive further comprises:

a moving element mounted for movement with respect to the unwinder on a support structure in a cross-direction in relation to the running direction of the web;

two adhesive nozzles that are attached to the moving element such that the nozzles are spaced apart in the cross-direction on the moving element;

wherein the two nozzles are fitted to apply adhesive on ends of the partial webs for attaching the ends of the partial webs onto the fiber web rolls;

two carrier beams that form part of a frame structure of the slitter-winder and are positioned on either side of the fiber web;

wherein the moving element defines a movement path across the partial webs; and wherein said each of the two nozzles has a home position at one cross directional end of the movement path across the partial webs, in which one of the nozzles is as close as possible to the immediate vicinity to one of the two carrier beams.

2. The device of claim 1 wherein the two nozzles are attached symmetrically in respect to a middle line defined by the moving element; and wherein the two nozzles extend to opposite directions in a cross-direction in relation to the running direction of the web.

3. The device of claim 1 wherein each of said two nozzles further comprises:

a nozzle arm attached to the moving element; and a nozzle head mounted to the nozzle arm.

4. The device of claim 1 further comprising:

a source of adhesive in supply relationship to each of the two nozzles; and a controller arranged to individually control a flow of adhesive from the source of adhesive to each of the nozzles that is applying adhesive.

5. A device for applying adhesive and a slitter-winder of a fiber web machine comprising:

an unwinder for unwinding a machine roll formed of a fiber web in a running direction, which direction is defined by the fiber web which is unwound from the machine roll;

slitter blades arranged to slit the fiber web unwound from the machine roll into partial webs;

a winder arranged to wind the partial webs onto fiber web rolls;

a moving element mounted for movement with respect to the unwinder on a support structure in a cross-direction in relation to the running direction of the web;

two adhesive nozzles that are attached to the moving element by arms such that the nozzles are spaced apart in a cross-direction in relation to the running direction of the web on the moving element and extend away from each other on the arms so that the arms extend in opposite directions in the cross-direction; and wherein the two nozzles are connected to a supply of adhesive and arranged to apply adhesive onto ends of the partial webs for attaching the ends of the partial webs onto the fiber web rolls, the nozzles arranged such that one of said nozzles extends away from the direction of travel so it can be accelerated to operating speed before traversing the partial webs, and the other of said nozzles can extend further in the direction of travel than the moving element can move.

* * * * *